US007424778B2

(12) United States Patent
Brenton

(10) Patent No.: US 7,424,778 B2
(45) Date of Patent: Sep. 16, 2008

(54) ADJUSTABLE THUMB RINGLET FOR PIVOTED CUTTING INSTRUMENTS

(76) Inventor: Billy H. Brenton, HC 75, P.O. Box 1012, Los Ojos, NM (US) 87551

( * ) Notice: Subject to any disclaimer, the term of this patent is extended or adjusted under 35 U.S.C. 154(b) by 518 days.

(21) Appl. No.: 10/802,322

(22) Filed: Mar. 16, 2004

(65) Prior Publication Data

US 2005/0204569 A1 Sep. 22, 2005

(51) Int. Cl.
*B26B 13/20* (2006.01)

(52) U.S. Cl. ..... 30/266; 30/270; 30/341

(58) Field of Classification Search ..... 030/231, 030/232, 266, 270, 271, 341; D8/57; 30/231–232, 30/270–271, 266, 341; 403/161
See application file for complete search history.

(56) References Cited

U.S. PATENT DOCUMENTS 590,330 A * 9/1897 Nolen ..... 30/254
1,814,821 A * 7/1931 Botts ..... 30/261
D134,395 S * 11/1942 Bain ..... D8/57
2,421,238 A * 5/1947 Borah ..... 229/122.25
2,776,482 A * 1/1957 Hafekost ..... 30/230
D198,963 S * 8/1964 Ericson ..... D8/57
3,374,541 A * 3/1968 Earnest III, et al. ..... 30/232
3,906,630 A * 9/1975 Megna ..... 30/260
3,913,422 A * 10/1975 Weber ..... 76/106.5
4,184,249 A * 1/1980 Megna et al. ..... 30/341
4,254,551 A * 3/1981 Megna et al. ..... 30/341
4,642,895 A * 2/1987 Gauvry ..... 30/341
4,742,617 A * 5/1988 Gauvry ..... 30/232
5,060,381 A * 10/1991 Taberlet ..... 30/232
5,109,608 A * 5/1992 Pracht ..... 30/341
5,125,159 A * 6/1992 Brenton et al. ..... 30/232
5,440,789 A * 8/1995 Lofland ..... 24/132 R
5,469,624 A * 11/1995 Brenton et al. ..... 30/232
5,781,999 A * 7/1998 Chang ..... 30/260
6,131,291 A * 10/2000 Mock ..... 30/266
6,249,977 B1 * 6/2001 Knoop ..... 30/232

* cited by examiner

*Primary Examiner*—Boyer D. Ashley
*Assistant Examiner*—Phong Nguyen
(74) *Attorney, Agent, or Firm*—Kenneth L Tolar

(57) ABSTRACT

Surgical and hairdressing scissors having an adjustable, articulated thumb ringlet rotatably connected to a handle by a flexible pin.

15 Claims, 5 Drawing Sheets

ADJUSTABLE THUMB RINGLET FOR PIVOTED CUTTING INSTRUMENTS

FIELD OF THE INVENTION

The present invention relates generally to pivoted cutting instruments and, more particularly, to the use of an adjustable, articulated thumb ringlet with a pivoted cutting instrument.

BACKGROUND OF THE INVENTION

The use of thumb ringlets for surgical and hair cutting scissors is known to provide greater comfort, better control and reduced fatigue for surgeons and barbers, respectively. However, these advantages are decreased if the ringlets do not properly fit the user's thumb. In U.S. Pat. No. 5,469,624 for "Interchangeable Thumb Ringlets For Pivoted Cutting And Grasping Instruments" which issued to Billy H. Brenton and James J. Stagnone on Nov. 28, 1995, interchangeable, flexible thumb ringlets are described for improving the comfort and control of scissors. The flexible ringlets are removably attached to the thumb handle portion of such instruments. In order to change the size of a ringlet, the ringlet must be removed and discarded. A ringlet having the desired size may then be installed.

Accordingly, it is an object of the present invention to provide pivoted cutting instruments having adjustable, articulated thumb ringlets.

Additional objects, advantages and novel features of the invention will be set forth, in part, in the description that follows, and, in part, will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the scissors having an adjustable, articulated thumb ringlet hereof includes a first shaft having a handle portion and a cutting portion separated by a first pivot location, the handle portion having a tubular portion; a thumb ringlet having an open portion and a hole opposite the open portion; a flexible pin adapted to be inserted through the hole in the thumb ringlet and into the tubular portion of the first shaft for rotatably connecting the thumb ringlet to the first shaft; a second shaft having a handle portion and a cutting portion separated by a second pivot location; and a second pin for pivotably connecting the second shaft to the first shaft in the region of the first pivot location and the second pivot location in such a manner that the cutting portion of the first shaft and the cutting portion of the second shaft cooperate as opposing cutting portions of the scissors.

In another aspect of the invention and in accordance with its objects and purposes, the scissors having an adjustable, articulated thumb ringlet hereof includes a first shaft having a handle portion and a cutting portion separated by a first pivot location; a thumb ringlet having an open portion; means for rotatably and flexibly connecting the thumb ringlet to the first shaft; a second shaft having a handle portion and a cutting portion approximately separated by a second pivot location; and means for pivotably connecting the second shaft to the first shaft in the region of the first pivot location and the second pivot location in such a manner that the cutting portion of the first shaft and the cutting portion of the second shaft cooperate as opposing cutting portions of the scissors.

Benefits and advantages of the present invention include, but are not limited to, allowing the user of a pivoted cutting instrument fitted with articulated thumb ringlets to comfortably and precisely utilize such instruments by adjusting the size of the ringlet to properly match their thumb size.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Briefly, the present invention includes a pivoted cutting instrument having an adjustable, articulated thumb ringlet.

Figure 1:
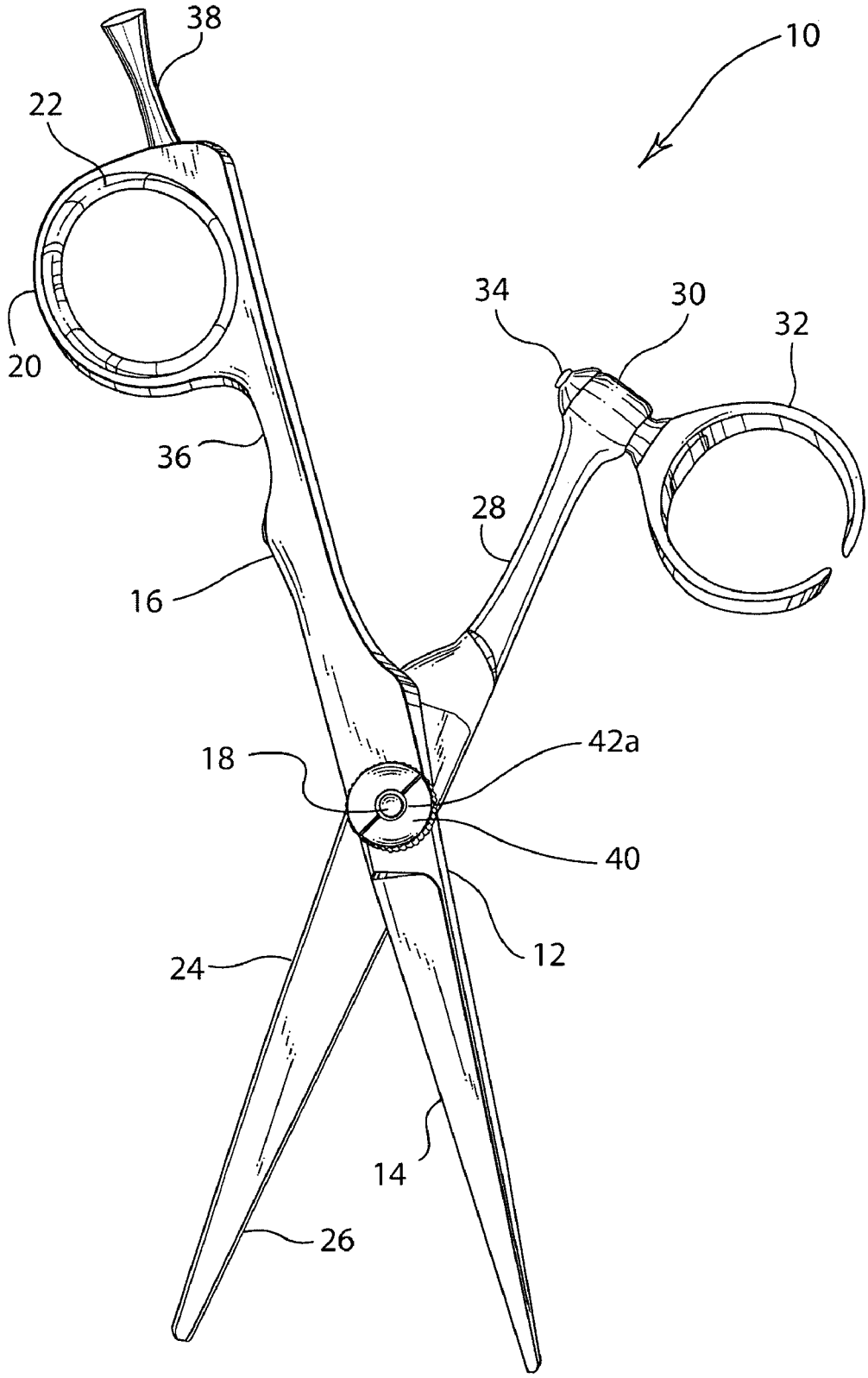
FIG. 1 is a schematic representation of the view from one side of the scissors of the present invention showing, in particular, the adjustable, articulated thumb ringlet thereof.

Reference will now be made in detail to the present preferred embodiments of the invention examples of which are illustrated in the accompanying drawings. In what follows, identical callouts will be used to identify similar or identical structure. Turning now to FIG. 1 hereof, shown is a schematic representation of a view from one side of scissors, 10, in an open configuration, illustrating, in particular, the adjustable, articulated thumb ringlet of the present invention. Shaft, 12, includes a cutting portion, 14, and a handle portion, 16, separated by pivot, 18, handle portion 16 bearing fixed finger ringlet, 20, having plastic insert, 22. Plastic insert 22 can be fabricated out of a variety of available plastics and is used to provide comfort and control of the scissors to a user when scissors 10 is positioned in various ways. Shaft, 24, includes cutting portion, 26, and handle portion, 28, bearing tubular section, 30, located substantially perpendicular to both the long axis of shaft 24 and to the axis of pivot 18, to which articulated and adjustable thumb ringlet, 32, is rotatably and flexibly attached using flexible pin, 34. Adjustable thumb ringlet 32 and pin 34 will be described in more detail hereinbelow. The terminus of flexible pin 34 further functions as a bumper for absorbing part of the force generated by the cutting process when the scissors is closed which would otherwise be transmitted to the user's hand. Depression, 36, in handle portion 16 cooperates with optional stabilizer, 38, located in the vicinity of fixed finger ringlet 20 on handle portion 16 to improve the stability of the scissors while in use by providing stable positions for a user's fingers when the user's thumb is located in thumb ringlet 32. Shown also in FIG. 1 is adjustable tensioner, 40, for adjusting the forcer between shaft 12 and shaft 24. As illustrated, threaded and knurled nut 40 is tightened or loosened on threaded pin, 42*a*, to provide tensioning. Scissors 10 can be fabricated from a variety of metals and alloys, such as stainless steel. Threaded pin 42*a* can be fabricated using a variety of materials, such as metals and alloys, and sturdy plastics, as examples.

Figure 2:
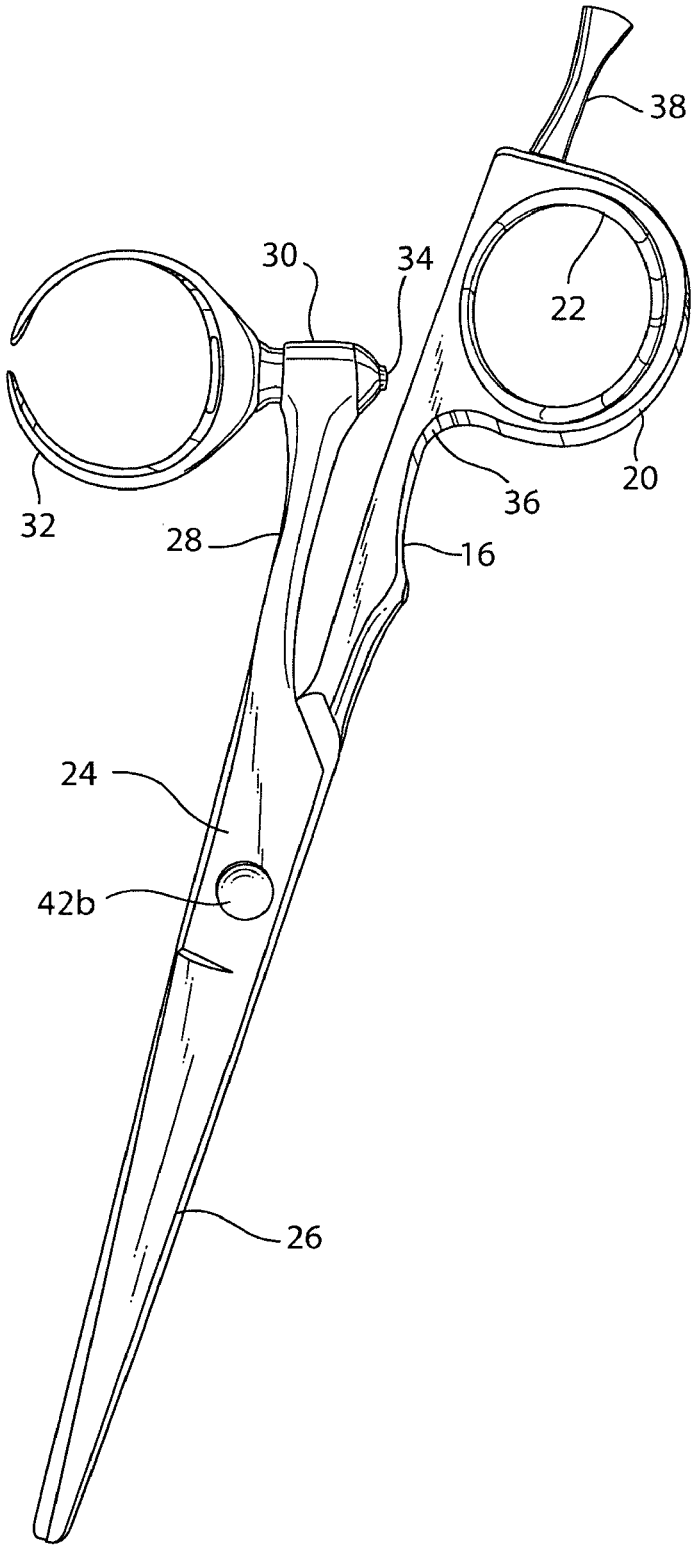
FIG. 2 is a schematic representation of the view from the other side of the scissors of the present invention shown in FIG. 1 hereof.

FIG. 2 is a schematic representation of a view from the other side of scissors 10 shown in FIG. 1 hereof, but in a closed configuration. The back portion, 42*b*, of threaded pin 42*a* is clearly illustrated.

Figure 3:
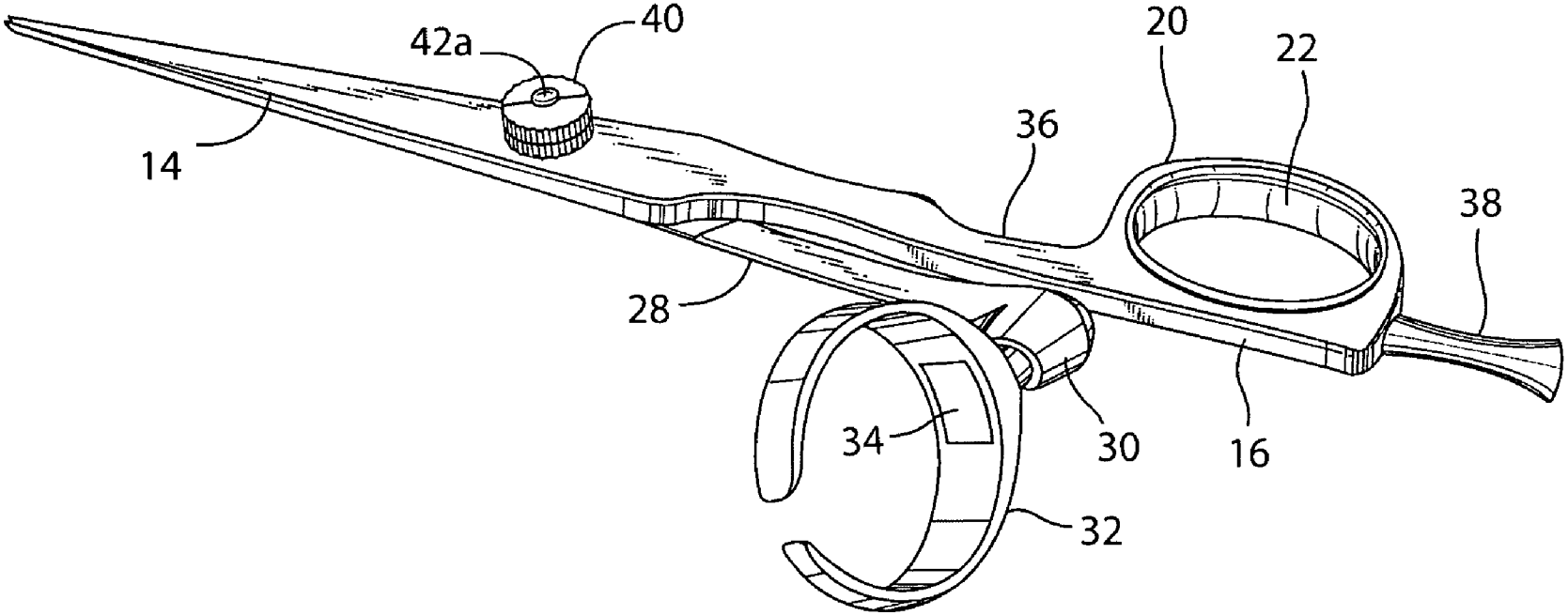
FIG. 3 is a schematic representation of a perspective view of the scissors shown in FIG. 1 hereof showing, in particular, the rotation of the thumb ringlet relative to the scissors shaft.

FIG. 3 is a schematic representation of a perspective view of the scissors shown in FIGS. 1 and 2 hereof in a closed configuration showing, in particular, the rotation of thumb ringlet 32 relative to scissors shaft 24.

Figure 4:
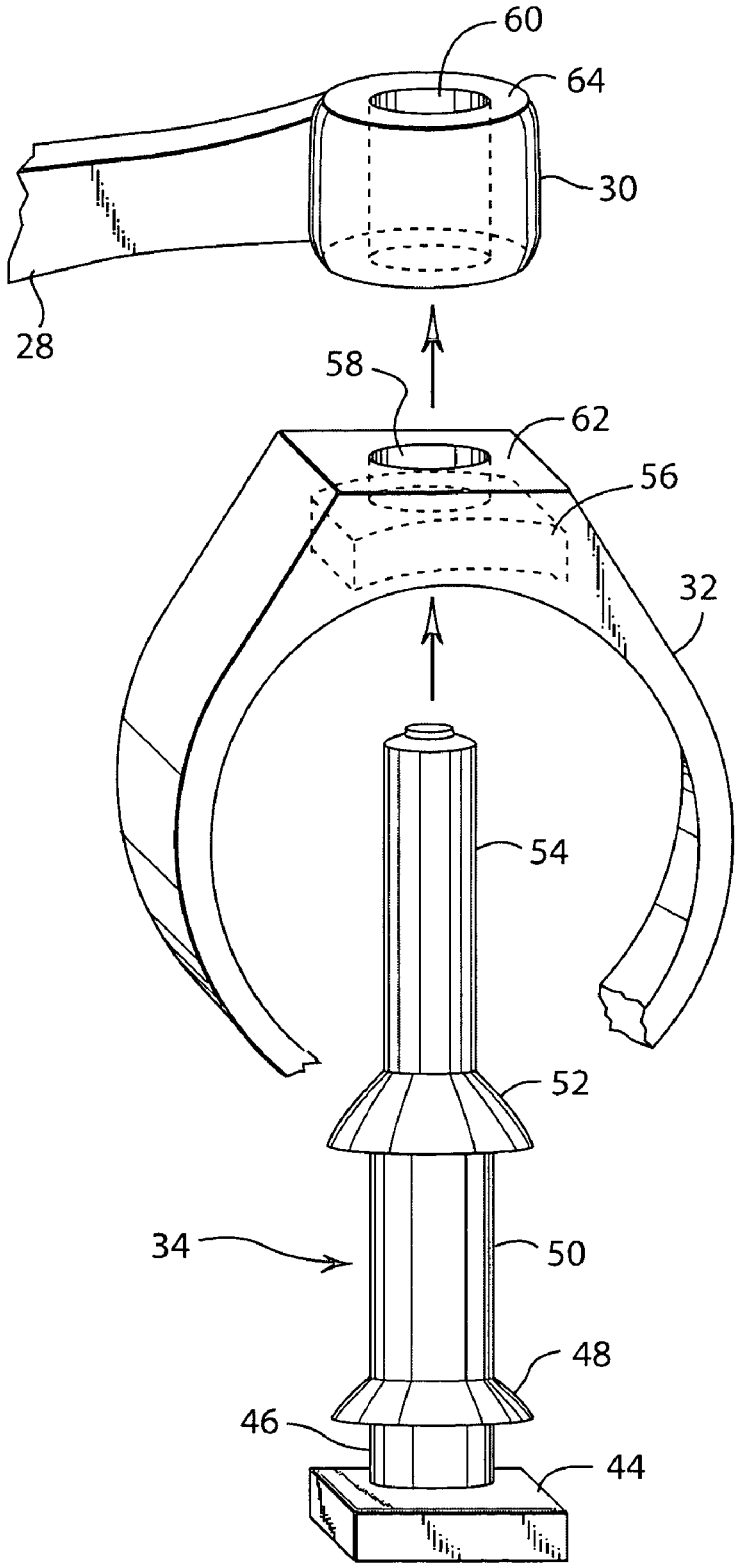
FIG. 4 is a schematic representation of an exploded perspective view of the flexible, the adjustable thumb ringlet and the cylindrical portion of the handle portion of the shaft into which the flexible pin is inserted of the scissors shown in FIG. 1 hereof.
Figure 5:
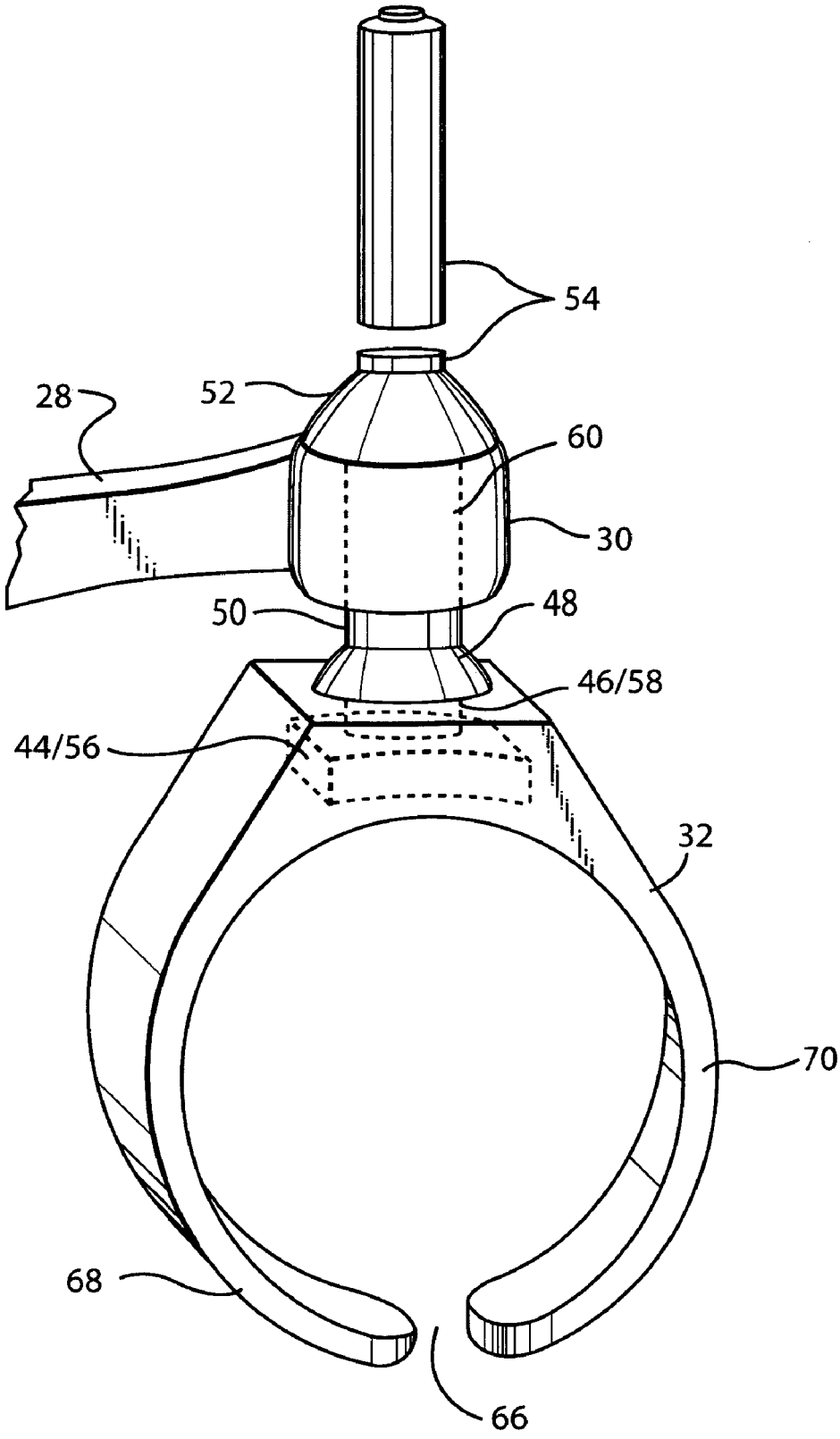
FIG. 5, is a schematic representation of the assembled thumb ringlet, and shaft of the present invention shown in FIG. 4 hereof.

FIG. 4 is a schematic representation of an expanded perspective view of pin 34, thumb ringlet 32 and tubular portion 30 of handle portion 28 of shaft 24 into which pin 34 is inserted. In the embodiment shown, flexible pin 34 includes substantially rectangular portion, 44, disposed at one end thereof, cylindrical portion, 46, flange, 48, cylindrical portion 50, flange, 52, and cylindrical portion 54. Thumb ringlet 32 includes substantially rectangular depression, 56, and hole, 58. In order to affix thumb ringlet 32 onto tubular portion 30 of handle portion 28, cylindrical portion 54 is first inserted through hole 58 in thumb ringlet 32 and through hole 60 in tubular portion 30. Cylindrical portion 54 is then grasped by a pair of pliers or some other grasping instrument to assist in pulling flexible pin 34 through holes 58 and 60, in such a manner that rectangular portion 44 is seated in depression 56, flange 48 holds cylindrical portion 46 in place in hole 58 by pressing against surface, 62, of thumb ringlet 32, and cylindrical section 50, once captured by flange 52 pressing against surface, 64, of tubular portion 30 can rotate and flex in hole 60 of tubular portion 30. It should be mentioned that a cylindrical or other shaped end piece 44 can also be used in place of a substantially rectangular one as illustrated in FIGS. 4 and 5 hereof. In the case of a cylindrical end piece, thumb ringlet 32 can rotate around cylindrical portion 46.

Flexible pin 34 is has been fabricated using Pebax® polyether block amides thermoplastic polymers (Pebax® is a registered trademark of ATOFINA Chemicals, Inc.), having durometer values between 200 and 750. Durometer values about 350 have been found to provide user comfort and ease of use of the scissors of the present invention. Other flexible materials can also be used, so long as they are durable, and permit the scissors to be used in a comfortable and efficient manner. In the case of surgical scissors, pins and other materials must be chosen such that they can withstand sterilization procedures.

FIG. 5, is a schematic representation of the assembled thumb ringlet, and tubular section. After assembly, cylindrical portion 54 may be cut down to a length which does not to interfere with the operation of scissors 10, while providing a bumper as described hereinabove. It should be noticed that thumb ringlet 32 has an opening, 66, located approximately opposite hole 58 therein. Thumb ringlet 32 can be fabricated from any metal that can be repeatedly bent such that arms, 68 and 70, can be straightened or bent further and the thumb ringlet retain its adjusted shape. In this manner, a single ringlet can serve several users. Silver and stainless steel have been employed for thumb ringlet 32, although other materials which can maintain their shape after repeated bending can be used.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Scissors comprising in combination:

a first shaft having a handle portion and a cutting portion separated by a first pivot location;

an adjustable, substantially circular thumb ringlet having an open portion and a connecting portion opposite the open portion, wherein the connecting portion includes a passage extending from the inner surface to the outside surface of the thumb ringlet, and is enlarged adjacent the inside surface to defined a cavity;

means for rotatably connecting said thumb ringlet to said first shaft, wherein the means for rotatably connecting said thumb ringlet to said first shaft is adapted to be inserted into the connecting portion, and is constructed and shaped to fit into the cavity such that it is flush with the inner surface of the thumb ringlet;

a second shaft having a handle portion and a cutting portion separated by a second pivot location; and means for pivotably connecting said second shaft to said first shaft in the region of the first pivot location and the second pivot location in such a manner that the cutting portion of said first shaft and the cutting portion of said second shaft cooperate as opposing cutting portions of said scissors.

2. The scissors as described in claim 1, wherein said means for rotatably connecting said thumb ringlet to said first shaft comprises a flexible pin.

3. The scissors as described in claim 2, wherein said flexible pin is fabricated using thermoplastic polymers.

4. The scissors as described in claim 1, wherein said adjustable thumb ringlet is deformable such that the size of said adjustable thumb ringlet can be adjusted to fit a user's thumb.

5. The scissors as described in claim 1, wherein said means for pivotably connecting said second shaft to said first shaft comprises means for adjusting the force between said opposing cutting portions of said scissors.

6. The scissors as described in claim 1, further comprising a finger ringlet disposed on said second shaft.

7. The scissors as described in claim 6, further comprising a finger stabilizer disposed on said second shaft in the vicinity of said finger ringlet.

8. Scissors comprising in combination:

a first shaft having a handle portion and a cutting portion separated by a first pivot location, said handle portion having a tubular portion;

an adjustable substantially circular thumb ringlet having an open portion and a hole opposite to the open portion and extending from the outside surface of the thumb ringlet inward to a cavity portion;

a flexible pin adapted to be inserted through the cavity portion and the hole in said thumb ringlet and into the tubular portion of said first shaft for rotatably connecting said thumb ringlet to said first shaft, and being constructed and shaped to fit into the cavity portion such that it is flush with the inner surface of the thumb ringlet;

a second shaft having a handle portion and a cutting portion approximately separated by a second pivot location; and a second pin for pivotably connecting said second shaft to said first shaft in the region of the first pivot location and the second pivot location in such a manner that the cutting portion of said first shaft and the cutting portion of said second shaft cooperate as opposing cutting portions of said scissors.

9. The scissors as described in claim 8, wherein said flexible pin is fabricated using thermoplastic polymers.

10. The scissors as described in claim 8, wherein said adjustable thumb ringlet is deformable such that the size of said adjustable thumb ringlet can be adjusted to fit a user's thumb.

11. The scissors as described in claim 8, wherein the hole in said thumb ringlet is disposed approximately opposite to the open portion.

12. The scissors as described in claim 8, wherein said flexible pin has a forward portion and a rearward portion, said thumb ringlet and said flexible pin cooperating such that the rearward portion of said flexible pin does not pass through the hole in said thumb ringlet when said flexible pin is inserted therethrough, and said flexible pin and said tubular portion of said handle portion of said first shaft cooperating such that the forward portion of said flexible pin is captured in the tubular portion of said first shaft when said flexible pin is inserted therethrough.

13. The scissors as described in claim 8, wherein the pivotable connection of said second shaft to said first shaft comprises means for adjusting the force between the opposing cutting portions of said scissors.

14. The scissors as described in claim 8, further comprising a finger ringlet disposed on said second shaft.

15. The scissors as described in claim 14, further comprising a finger stabilizer disposed on said second shaft in the vicinity of said finger ringlet.

* * * * *